US006439393B1

(12) United States Patent
Zeller

(10) Patent No.: US 6,439,393 B1
(45) Date of Patent: Aug. 27, 2002

(54) METHOD AND APPARATUS FOR SEPARATING EXCAVATED MATERIAL

(76) Inventor: Bruce K. Zeller, 6150 W. Saskan Ranch Cir., Flagstaff, AZ (US) 86001

( * ) Notice: Subject to any disclaimer, the term of this patent is extended or adjusted under 35 U.S.C. 154(b) by 0 days.

(21) Appl. No.: 09/503,283

(22) Filed: Feb. 14, 2000

(51) Int. Cl.[7] ..... B07B 1/00
(52) U.S. Cl. ..... 209/405; 209/420
(58) Field of Search ..... 209/420, 421, 209/405, 408, 409, 412, 395

(56) References Cited

U.S. PATENT DOCUMENTS

| | | | | | |
|---|---|---|---|---|---|
| 393,295 | A | * | 11/1888 | Carrico | 209/405 |
| 619,443 | A | | 2/1899 | Smith | |
| 3,307,698 | A | | 3/1967 | Haffner | |
| 3,980,555 | A | * | 9/1976 | Freissle | 209/408 |
| 4,074,017 | A | * | 2/1978 | Kinsey | 429/1 |
| 4,197,194 | A | | 4/1980 | Read | |
| 4,250,038 | A | | 2/1981 | Dryden | |
| 4,265,742 | A | | 5/1981 | Bucker et al. | |
| D263,836 | S | | 4/1982 | Read | |
| 4,805,703 | A | | 2/1989 | Carlsson | |
| 4,865,720 | A | | 9/1989 | Gilmore | |
| 4,960,510 | A | | 10/1990 | Wolff | |
| 4,998,625 | A | | 3/1991 | Read | |
| 5,002,656 | A | | 3/1991 | Johanson | |
| 5,100,539 | A | | 3/1992 | Tsutsumi | |
| 5,244,098 | A | | 9/1993 | Hadden | |
| 5,285,604 | A | * | 2/1994 | Carlin | 52/79.1 |
| 5,601,038 | A | * | 2/1997 | Welch et al. | 108/193 |
| 5,624,038 | A | | 4/1997 | Curtis | |
| 5,641,071 | A | * | 6/1997 | Read et al. | 209/319 |
| 5,849,198 | A | * | 12/1998 | Sharpless | 210/693 |
| 5,887,727 | A | * | 3/1999 | Ames | 209/352 |
| 5,950,841 | A | * | 9/1999 | Knox et al. | 209/315 |

* cited by examiner

*Primary Examiner*—Donald P. Walsh
*Assistant Examiner*—Joseph Rodriguez
(74) *Attorney, Agent, or Firm*—Snell & Wilmer, L.L.P.

(57) ABSTRACT

A method and apparatus for separating material, particularly excavated material is presented. The method and apparatus utilize a releasable and interchangeable screen assembly which is positioned on top of a frame having a slanted grate. The screen assembly includes bar members which traverse the top of the screen and inverted hook members attached to a top surface of the bar members to enable an equipment bucket to engage the inverted hook members in order to lift and move the screen assembly.

13 Claims, 4 Drawing Sheets

METHOD AND APPARATUS FOR SEPARATING EXCAVATED MATERIAL

FIELD OF THE INVENTION

The present invention relates, generally, to a method and apparatus for separating excavated materials and, more particularly, to a method and apparatus for separating excavated material which utilizes a releasable and interchangeable screen element which is positioned on top of, and releasably engaged to, a frame. Although particularly suited for the separation and recycling of excavated material, the method and apparatus of the present invention may also be used to separate a variety of other materials which comprise some elements that can pass through the releasable screen element. The releasable screen element may be configured of various different screen size openings as well as overall sizes thereby creating a plurality of releasable screen elements which can be easily interchanged with one another on top of the frame.

BACKGROUND OF THE INVENTION

The separation of excavated material into usable types of material such as, for example, sand, gravel and rock, has been performed by utilizing a number of methods and apparatus. For example, the material separating method and apparatus shown in U.S. Pat. No. 5,244,098 discloses a frame having a tall end and a short end, a vibrating separating screen as a separating surface within the frame, and a fixed angle feed directing plate which functions as a funneling surface to direct feed material into the separating surface at the tall end of the frame. Another example is shown in U.S. Pat. No. 4,197,194 which describes a portable loam screening apparatus which includes a generally square shaped shaker screen supported by a box-like frame having a tall end and a short end. When coarse material is dumped onto the shaker screen, the coarse material falls from the lower end of the shaker screen outside the frame while the loam passes through the shaker screen to within the box-like frame.

Other examples of separating methods and devices are shown in U.S. Pat. Nos. 3,307,698, 4,960,510 and 5,100,539. U.S. Pat. No. 3,307,698 discloses a portable oscillating rock separator having an inverted pyramidical hopper and a sloping grid covering the hopper. Although the sloping grid includes a series of parallel longitudinal rails that are positioned and assembled by a journal tube and a cross plate, the screen is not disclosed as being removable.

U.S. Pat. No. 5,100,539 describes a dual screen apparatus and method for sizing and separating particles of a material. The apparatus includes a stand and a frame with suspension assemblies attached to the stand and the frame for movably suspending the frame on the stand. Further, a pair of inclined screens are removably mounted in a pair of screen boxes which are removably mounted on the frame such that each of the screens slopes downwardly from an intermediate portion of the frame toward an end of the frame. A motor is also mounted on the frame for vibrating for vibrating the frame and the attached screens. Although both the screen boxes and inclined screens are removably mounted, neither of these elements includes a feature for aiding in the positioning and removal of the elements within and from their respective locations within the apparatus.

U.S. Pat. No. 4,960,510 discloses a screening apparatus having a screen grid with a plurality of exchangeable screen elements. The screening apparatus includes a screen grid where sieve elements directly contact one another at the top side of their surfaces to provide a continuous surface having sieve openings and separators or retaining bars are present on their undersides for removably boshing the screen elements to the carrier framework. This apparatus functions to make the active sifting surface of the screen grid in a screening apparatus as large as possible by incorporating the marginal resting areas of the screen elements into the acting sifting surface and to avoid protruding attachment elements on the top side of the screen surface.

Although screen elements or screen grids shown in the prior art are described as being removable and often exchangeable, none of the screen grids or screen elements include means for assisting in the placement and removal of the screen grids or screen elements within the separating apparatus. Accordingly, many of the prior art separating devices must utilize more than one person to position and remove the screen grid or screen element from that area of the separating apparatus where the screen resides, this area typically being the frame of the separating apparatus. Often times, different screen sizes are used to separate and recycle different types of material. Therefore, there is a need for a separating apparatus which enables the easy placement and removal of removable screen grids or screen elements within and out of the separating apparatus. Therefore, there is also a need for a removable screen assembly for utilization within a separating apparatus which includes elements specifically provided to enable the quick and easy placement and removal of the screen assembly or interchangeable screen assemblies which comprises part of the separating apparatus.

SUMMARY OF THE INVENTION

A separating method and apparatus are provided which enable the efficient and easy removal of a screen assembly, or interchangeable screen assemblies, that are utilized within the separating apparatus for separating materials from one another.

In accordance with one aspect of the present invention, a separating apparatus for classifying and recycling material is provided which includes a frame member having a slanted grate which has two opposite sides and two opposite ends and a removable screen member positioned on the top surface of the frame member where the removable screen member includes at least one inverted hook member extending from the top surface of the screen member. The slanted grate preferably forms less than a ninety degree angle relative to a ground surface upon which the frame is placed. The inverted hook member or members may be positioned on one or more bar members which extend across the top surface of the screen member and are preferably irremovably secured to one or more of the bar members. These inverted hook members are then easily engaged by the edge of a loader/backhoe bucket so that the operator of the loader/backhoe can easily place and remove the screen member on the frame without the need for additional manpower or equipment. To enable engagement by a loader/backhoe bucket, the bar members containing the inverted hook(s) may comprise a number of configurations, one of the simplest comprising one bar member which horizontally traverses the top surface of the screen member and two inverted hook members spaced equidistantly from one another on the top side of the bar member. Another simple configuration may include two bar members which vertically traverse the top surface of the screen member where one inverted hook is secured to the top surface of each of the bar members such that the inverted hook members are positioned directly across from one another.

In accordance with another aspect of the present invention, the frame member having a slanted grate is provided with at least one flange extending from a bottom side of the slanted grate thereby enabling a loader/backhoe bucket to transport and move the entire frame member by engaging the flange(s). More specifically, the loader/backhoe bucket contacts the bottom side of the slanted grate from the rear of the frame member such that the flange(s) are positioned within the interior of the bucket and adjacent to the outer edge of the bucket. The bucket is then raised and the flange(s) positioned adjacent to the outer surface of the bucket to prevent the frame from slipping off of the bucket when the frame is raised from the ground. The frame member can then be transported to the next desired location.

In accordance with still another aspect of the present invention, a portable screen element is provided which includes a screen member having two opposite sides, two opposite ends, and top and bottom surfaces and at least one bar member traversing the top surface of the screen member where the bar member includes at least one inverted hook member secured to its top surface. Further, as previously described above, the bar member(s) and inverted hook member(s) contained in the screen element may comprise a number of different configurations including the two simplest configurations described above.

In accordance with yet another aspect of the present invention, a method for separating and recycling material is provided which includes the steps of positioning a frame member having a slanted grate relative to a ground surface on the ground, placing a removable screen over the top of the slanted grate by engaging hooks extending from the top of the removable screen with a vehicle or apparatus capable of moving the removable screen, and depositing material to be separated on the top surface of the screen so that the material is separated by passing through both the screen and the grate, both of which are slanted toward the ground relative to the ground surface.

It is a principal object of the present invention to provide an efficient and easy method and apparatus for placing and removing removable screen assemblies contained within a separating apparatus. Achieving this objective eliminates the requirement for tools and extra manpower in removing and changing the screen assembly. As a result, a single equipment operator can easily use the loader/backhoe bucket to carry out the placement and removal of the screen assembly.

Various other aspects and advantages of the present invention are set forth with particularity in the detailed description of exemplary embodiments of the invention.

DETAILED DESCRIPTION OF THE DRAWING FIGURES

A more complete understanding of the present invention may be derived by referring to the detailed description and claims when considered in connection with the following illustrative Figures, which may not be to scale. In the following Figures, like reference numbers refer to similar elements throughout the Figures.

DETAILED DESCRIPTION OF THE EXEMPLARY EMBODIMENTS

It should be appreciated that the particular implementations shown and described herein are illustrative of the invention and its best mode and are not intended to otherwise limit the scope of the present invention in any way.

Figure 1:
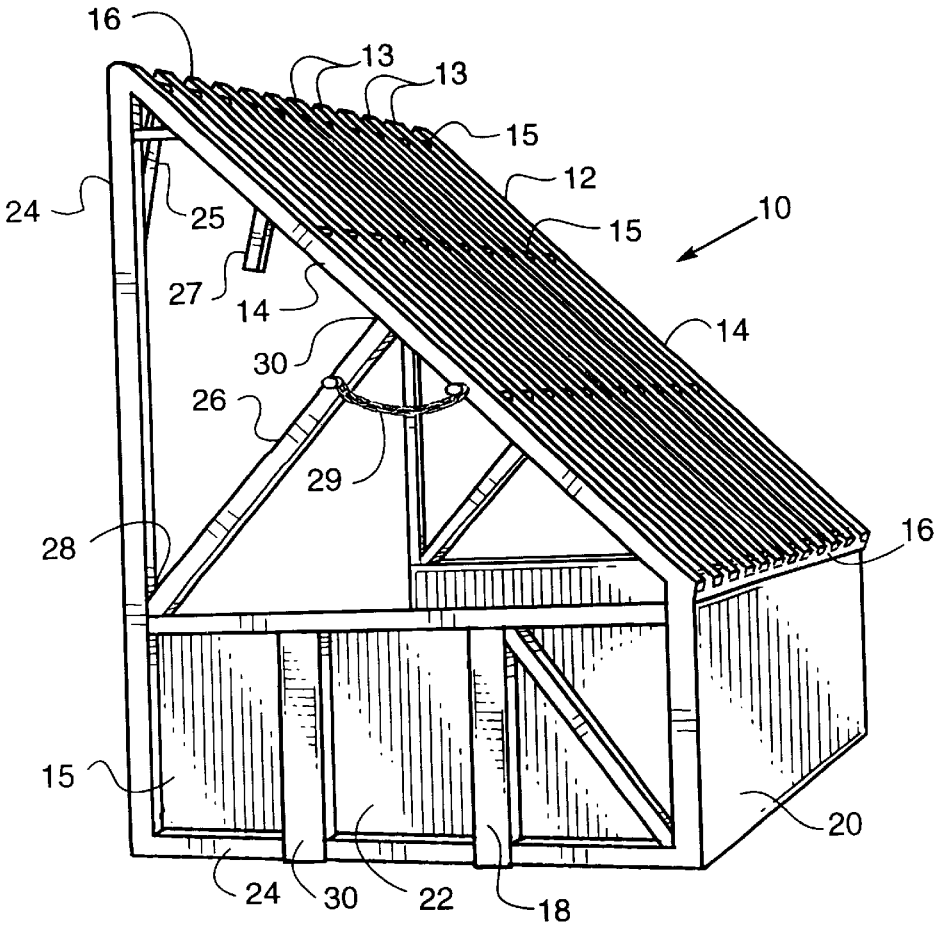
FIG. 1 is a perspective view of the frame member of the separating apparatus of the present invention.
Figure 3:
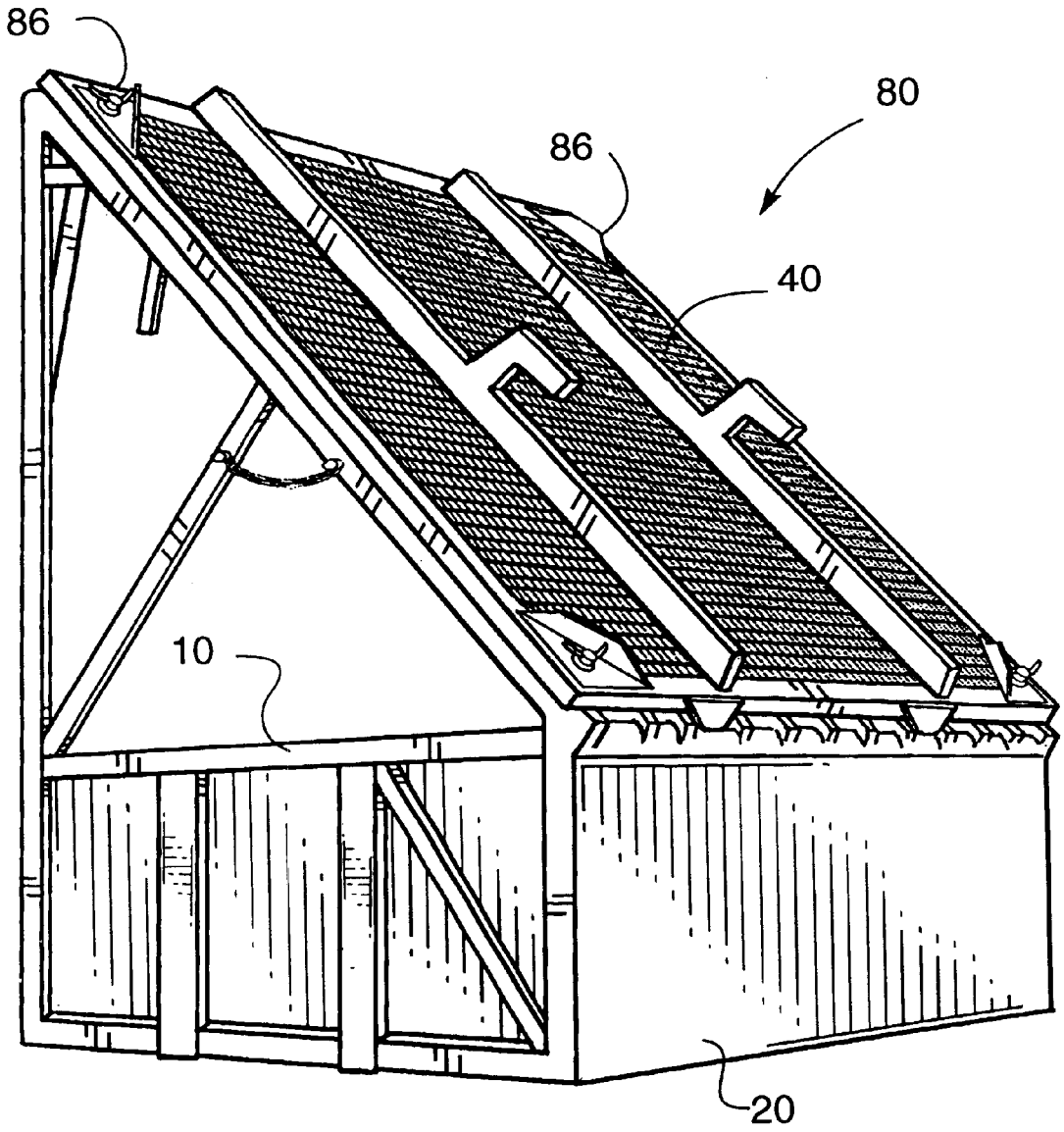
FIG. 3 is a perspective view of the separating apparatus of the present invention shown with the screen assembly in place.

FIG. 1 is a perspective view of the frame member of the separating apparatus (See FIG. 3) of the present invention. Frame member 10 includes a slanted grate 12 having two opposite sides 14 and two opposite ends 16, base member 18 having a front plate 20 and opposite side plates 22, a pair of back legs 24 separated by a horizontal support bar 25, and opposite side support members 26. Slanted grate 12 comprises a plurality of vertical bars 13 located between opposite ends 16 of slanted grate 12 which are parallel with opposite sides 14 of slanted grate 12. A minimum number of support beams 15 are preferably positioned between and perpendicular to opposite sides 14 of slanted grate 12.

Also, one or more flanges 27 extend from a bottom side of the slanted grate 12 in order to enable transport and movement of the entire frame member 10. In order to transport and move frame member 10, a loader/backhoe bucket engages flange(s) 27 by contacting the bottom side of slanted grate 12 such that flange(s) 27 reside within the bucket and adjacent to a front edge of the bucket. This engagement temporarily secures the frame member 12 to the bucket when frame member 12 is lifted from the ground and moved with the loader/backhoe bucket.

The pair of back legs 24 of base member 18 are secured opposite one another on the top ends of the opposite side plates 22 of the base member 18, respectively, on those top ends of the opposite side plates 22 that are opposite the front plate 20 of the base member 18. Slanted grate 12 is positioned and secured such that its opposite ends rest on the horizontal support bar 25 and the front plate 20 of the base member 18, respectively. As a result, slanted grate 12 will preferably rest at less than a ninety degree angle relative to the surface of the ground on which the separator apparatus is placed. Opposite side support members 26 having first ends 28 and second ends 30 are secured such that first ends 28 meet the attachment point of the back legs 24 and opposite side plates 22 and second ends 30 meet opposite sides 14, respectively, of slanted grate 12 at a midpoint 32 along the length of the opposite sides 14.

The frame member 10 is preferably comprised of a rigid and durable metal such as, but not limited to, steel and the like. All elements which comprise the frame member 10 are welded together to ensure the integrity of the structure which comprises frame member 10. During use, material to be separated is deposited on the slanted grate 12 from that side of the separating apparatus which contains the back legs 24 of the base member 18. Smaller course material falls through slanted grate 12 while larger course material falls off of slanted grate 12 and in front of front plate 20 of base member 18. The recycled smaller course material is then moved from the back open end of the base member 18.

Figure 2:
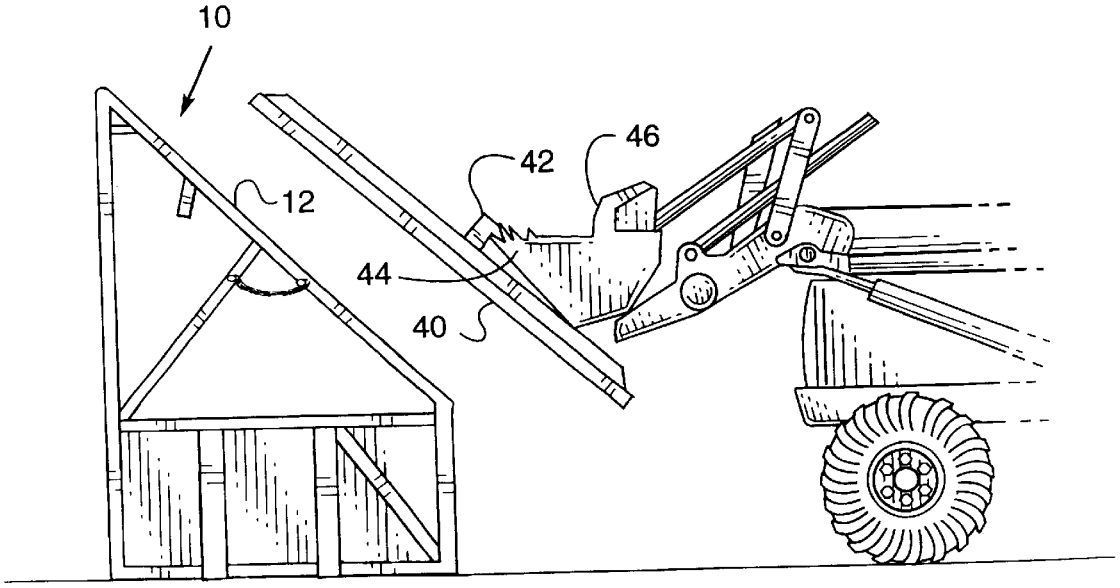
FIG. 2 is a side elevational view of the frame member of the separating apparatus of the present invention shown in FIG. 1 with a loader/backhoe moving the screen assembly of the present invention into place on the frame member.

A side elevational view of the placement of the removable and portable screen assembly 40 of the separating apparatus of the present invention onto the frame member 10 of the separating apparatus of the present invention is shown in FIG. 2. Portable screen assembly 40 is later discussed in more detail with reference to FIG. 4. In FIG. 2, portable screen assembly 40 having inverted hook members 42 is lifted and transported by engaging the front end 44 of an equipment bucket 46 with inverted hook members 42. Portable screen assembly 40 is then easily positioned over the top of slanted grate 12 of the frame member 10 to produce the separating apparatus 80 of the present invention shown in FIG. 3.

Separating apparatus 80 of the present invention includes frame member 10, previously described in detail with reference to FIG. 1, and removable and portable screen assembly 40, later described in detail with reference to FIG. 4. Once the portable screen assembly 40 is positioned over the top of slanted grate 12, portable screen assembly 40 may be held in place with respect to slanted grate 12 via a lip member (See FIG. 7) extending from the top edge of portable screen assembly 40 around a perimeter of portable screen assembly 40 which fits over the outside perimeter of slanted grate 12. Portable screen assembly 40 may also be held in place with respect to slanted grate 12 by any other means which still renders portable screen assembly as being removable such as, for example, one or more hook members extending from a front end of portable screen assembly 40 such that they are capable of engaging the top end of slanted grate 12. Portable screen assembly 40 may be further secured to frame member 10 by locking mechanisms 86 placed through portable screen assembly 40 and into frame member 10. Locking mechanisms 86 may be placed in one or more positions on portable screen assembly 40 and frame member 10, but are preferably positioned around the perimeter of the screen assembly 40 and frame member 10. Further, safety features such as chain and hook assembly 29 (See FIG. 1) may be provided to ensure that portable screen assembly 40 is secured to frame member 10. Examples of other locking mechanisms/safety features that could be used for this purpose include, but are not limited to, lock and pin configurations where the pin passes through both screen assembly 40 and frame member 10 before locking the pin member in place, nut and bolt assemblies, tie downs, chain binders, ratchet binders, and the like.

During use, material to be separated is deposited on portable screen assembly 40 thereby allowing even finer material than that passing through slanted grate 12 to pass through portable screen assembly 40 to further separate and recycle the material. Material too coarse to pass through portable screen assembly 40 falls off of portable screen assembly 40 and in front of front plate 20 of base member 18. The finer material which passed through portable screen assembly 40 is then removed from the back open end of base member 18. Accordingly, this finer material may continue to be further separated by changing out portable screen assembly 40 and replacing it with a portable screen assembly having smaller apertures.

Figure 4:
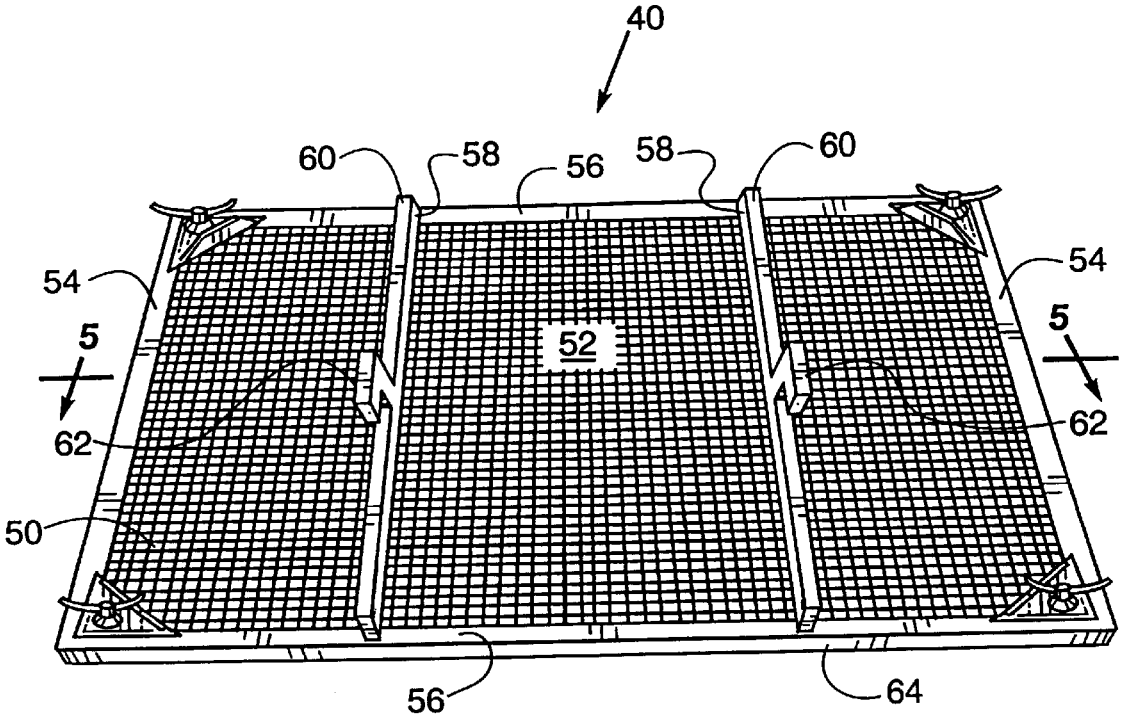
FIG. 4 is a perspective view of a first exemplary embodiment of the portable screen assembly of the present invention.

Turning now to FIG. 4, there is shown a perspective view of a first exemplary embodiment of the portable screen assembly 40 of the present invention. Portable screen assembly 40 includes a screen member 50 having a top surface 52, bottom surface (not shown), two opposite sides 54 and two opposite ends 56, at least one bar member 58 having a top side 60, a bottom side (not shown) which traverses the top surface 52 of the screen member 50, and at least one inverted hook member 62 extending from the top side(s) 60 of the bar member(s). The perimeter of screen member 50 is surrounded by lip 64 which extends outward from the back surface (not shown) of the screen member 50. Lip 64 fits around the outer perimeter of slanted grate 12 when portable screen assembly 40 is properly positioned in the separating apparatus 80 of the present invention.

The first exemplary embodiment shown in FIG. 4 includes two bar members 58 which traverse the top surface 52 of screen member 50 such that the bar members 58 lie between opposite ends 56 of screen member 50 and parallel with opposite sides 54 of screen member 50. An inverted hook member 62 is positioned near the middle of each bar member extending from the top side 60 of bar members 58. Inverted hook members 62 are positioned such that they are in horizontal alignment with one another. Accordingly, the front end of an equipment bucket can easily engage inverted hook members 62 to lift and move portable screen assembly 40. Portable screen member 40 can then be easily positioned onto frame member 10 without the equipment operator having to leave the equipment. This ability is a great advantage over prior art separating apparatus having screen assemblies in that additional tools and/or manpower is needed to move the screen assemblies contained in the prior art.

Portable screen assembly 40 is preferably comprised of angle iron, crusher screen of various sizes, one-inch steel elements, and the like.

Figure 5:
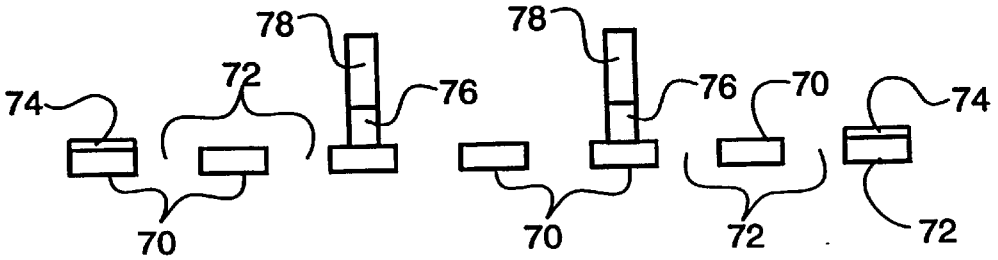
FIG. 5 is a cross section taken along line 5—5 of FIG. 4.

FIG. 5 shows a cross section taken along line 5—5 of FIG. 4. As can be seen from the cross section, screen member 50 is represented by a series of spaced apart segments 70 with the openings 72 between the segments depicting the apertures in screen member 50. Lip 64 is portrayed by a small lining 74 contained on the top of the outermost segments 70 while bar members 58 and inverted hook members 62 are represented by bars 76 and 78, respectively.

Figure 6:
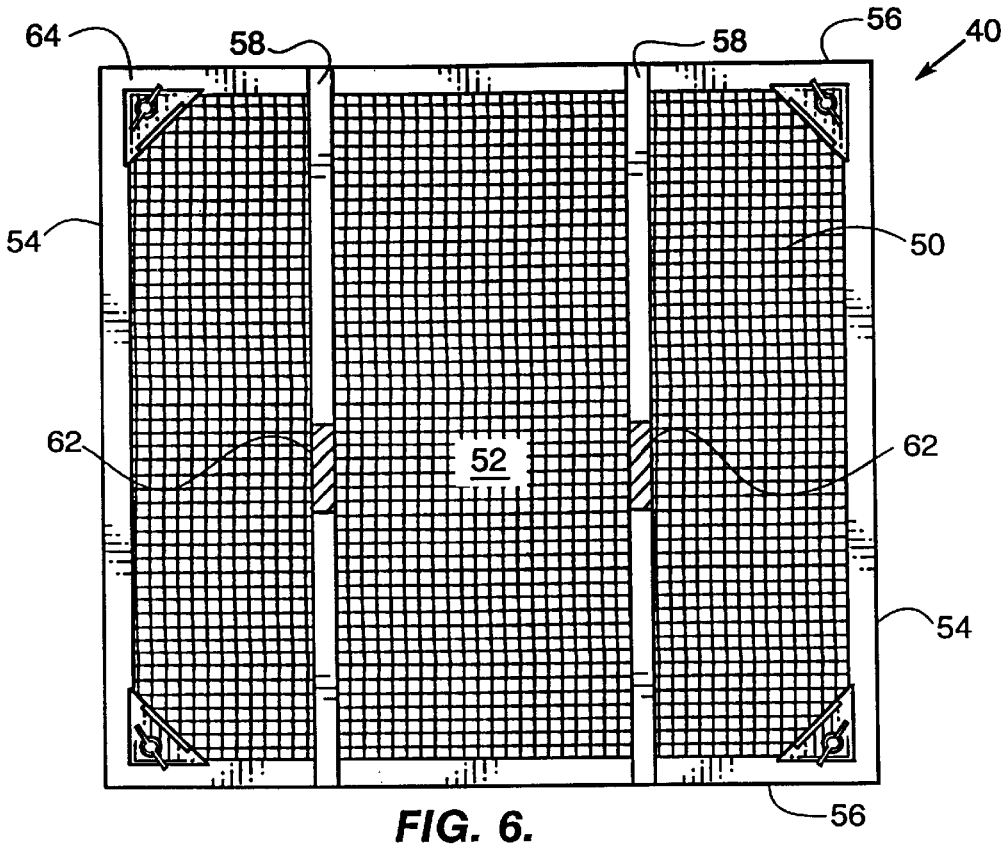
FIG. 6 is a top plan view of the first exemplary embodiment of the screen assembly of the present invention shown in FIG. 4.

A top plan view of the first exemplary embodiment of the screen assembly 40 of the present invention shown in FIG. 4 is depicted in FIG. 6. Lip 64 extends around the perimeter of screen member 50 which has a top surface 52 defined between two opposite sides 54 and two opposite ends 56. Bar members 58 vertically traverse the top surface 52 of screen member 50 such that bar members 58 lie parallel to opposite sides 54. Bar members 58 further include one inverted hook member 62 positioned in a middle top surface of each bar member 58.

Figure 7:
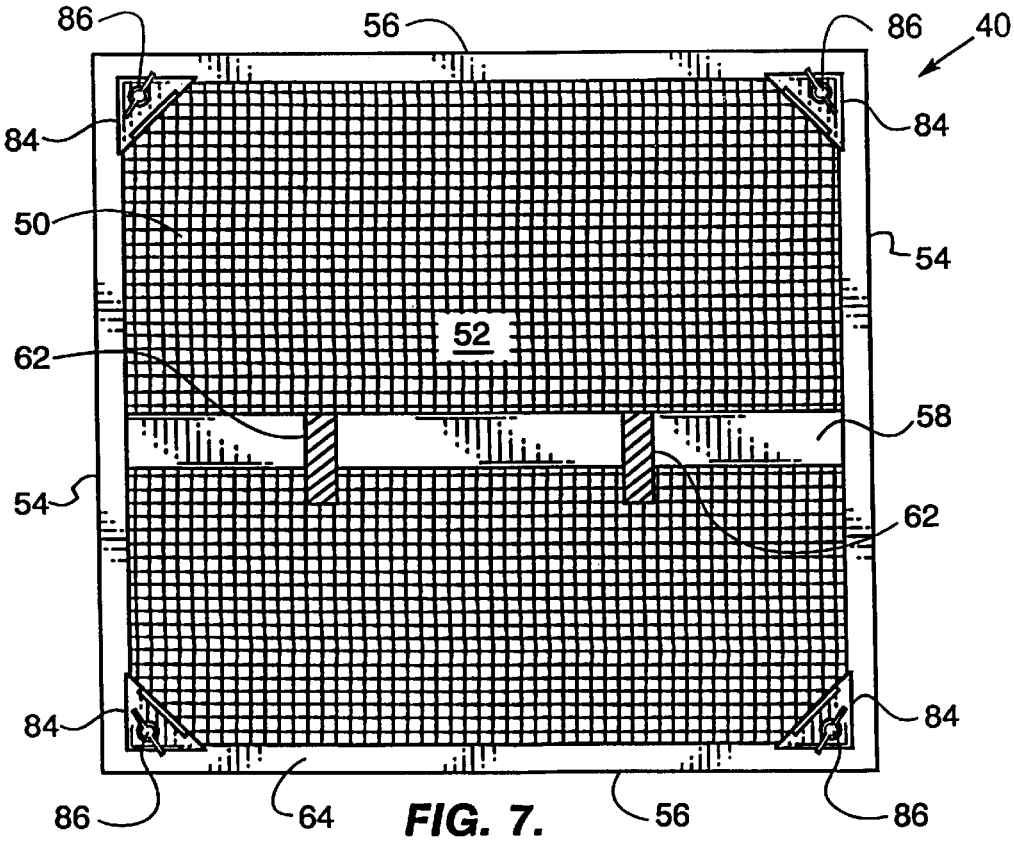
FIG. 7 is a top plan view of a second exemplary embodiment of the screen assembly of the present invention.

The top plan view of a second exemplary embodiment of the screen assembly 40 of the present invention is shown in FIG. 7. The configuration of FIG. 7 is the same as that in FIG. 6 with the exception of the placement of the bar member 58 and the inclusion of support corners 84 which may be used for installing a locking mechanism 86 for holding the screen assembly 40 in place against frame member 10. Examples of locking mechanisms that could be used in accordance with the present invention have been previously described. In FIG. 7, bar member 58 horizontally traverses screen member 50 such that it is perpendicular to opposite sides 54. However, it is important to note that in this exemplary embodiment, it may be necessary to recess bar member 58 within screen member 50 such that the top side 60 of bar member 58 lies flush with the top surface of screen member 50. This configuration may be necessary to prevent material from being trapped on horizontal bar member 58 during separation of the material. Two inverted hook members 62 are spaced equidistant from one another and positioned on a top surface of bar member 58. Since inverted hook members 62 will align in parallel with opposite sides

54, inverted hook members 62 will not catch or block material from either passing through screen assembly 40 or falling off the end of screen assembly 40.

The method and apparatus of the present invention for separating excavated material simplifies clarification and recycling of materials such as rocks, sand and gravel. It should be understood that the method and apparatus of the present invention may also be used for separating other types of solid materials in addition to excavated material. This method and apparatus for separating material provides a more efficient, reliable, and durable method than those previously known, especially with respect to the time and manpower costs saved during the changing of screen assemblies. As a result, the method and apparatus of the present invention are more profitable than currently existing methods and apparatus which require the use of a plurality of different sized screen assemblies for separating material.

The present invention has been described above with reference to exemplary embodiments. However, those skilled in the art having read this disclosure will recognize that changes and modifications such as, for example, eliminating the bar member and attaching the inverted hook members directly to a top surface of the screen member, may be made to the exemplary embodiments without departing from the scope of the present invention. These and other changes or modifications are intended to be included within the scope of the present invention, as expressed in the following claims.

I claim:

1. A separating apparatus for classifying and recycling excavated material comprising:

a frame member having a slanted grate having two opposite sides and two opposite ends wherein said slanted grate forms less than a ninety degree angle relative to a ground surface; and a removable screen member positioned on a top surface of said frame member, said screen member having two opposite sides, two opposite ends, a top surface, a bottom surface, and at least one bar member seated on top of said screen member, vertically traversing the top surface of said screen member, said bar member having at least one inverted hook member extending therefrom for engaging a mobile vehicle or apparatus.

2. The separating apparatus of claim 1 further comprising at least one flange extending from a bottom side of said slanted grate.

3. The separating apparatus of claim 1 further comprising at least one bar member traversing the top surface of said removable screen member wherein said bar member has a top side and a bottom side and said inverted hook member extends from the top side of said bar member.

4. The separating apparatus of claim 3 wherein said removable screen member includes one bar member secured between opposite sides of said screen member and at least two inverted hook members extending from said bar member.

5. The separating apparatus of claim 3 wherein said removable screen member includes at least two bar members secured between opposite ends of said screen member and at least one inverted hook member extending from each of said bar members.

6. The separating apparatus of claim 3 wherein said removable screen member further comprises means for releasably securing the bottom surface of said screen member to a top surface of a frame.

7. The separating apparatus of claim 6 wherein said releasable securing means includes a lip extending from the bottom surface of said screen member such that said lip member fits over an upper end of the top surface of the frame.

8. The separating apparatus of claim 6 wherein said releasable securing means includes at least one hook member extending from the bottom surface of said screen member such that said hook member engages an upper end of the top surface of the frame.

9. The separating apparatus of claim 6 wherein said releasable securing means includes a locking mechanism positioned in at least two corners of said screen member.

10. The separating apparatus of claim 8 further comprising a triangular shaped support plate positioned over the top surface of each corner of said screen member.

11. The separating apparatus of claim 6 wherein said releasable securing means comprises a safety chain and hook assembly.

12. A method for separating and recycling excavated material comprising the steps of:

positioning a frame member having a slanted grate relative to a ground surface on the ground;

placing a removable screen over a top of the slanted grate by engaging hooks extending from a top surface of the removable screen member with a moving vehicle or apparatus, wherein said hooks are attached in an inverted position to at least one bar member and said at least one bar member is seated on top of said removable screen and vertically positioned over a top surface of said removable screen; and depositing excavated material on the top surface of the removable screen member such that the excavated material is separated by passing through both the removable screen member and the slanted grate.

13. The method of claim 12 further comprising the step of securing the removable screen member to the slanted grate before depositing excavated material on the removable screen member.

* * * * *